US006455789B1

(12) United States Patent
Allison

(10) Patent No.: US 6,455,789 B1
(45) Date of Patent: Sep. 24, 2002

(54) SHOCK-RESISTANT ELECTRICAL OUTLET

(75) Inventor: John Allison, Chandler, AZ (US)

(73) Assignee: Smart Products, Inc., Tempe, AZ (US)

( * ) Notice: Subject to any disclaimer, the term of this patent is extended or adjusted under 35 U.S.C. 154(b) by 0 days.

(21) Appl. No.: 09/777,200

(22) Filed: Feb. 2, 2001

(51) Int. Cl.[7] ..... H01R 33/96

(52) U.S. Cl. ..... 200/51.09; 200/51.12; 439/188

(58) Field of Search ..... 200/51.09, 51.12, 200/51.1, 51.02, 51.11; 439/188, 139, 143, 346, 259, 261, 692, 693, 694

(56) References Cited

U.S. PATENT DOCUMENTS

| | | | | |
|---|---|---|---|---|
| 2,540,496 A | | 2/1951 | Sperrazza | |
| 2,751,567 A | | 6/1956 | Bissell | |
| 3,699,285 A | | 10/1972 | Leatherman | |
| 3,755,635 A | | 8/1973 | McGill | |
| 5,095,182 A | | 3/1992 | Thompson | |
| 5,347,095 A | | 9/1994 | Zeder | |
| 5,513,999 A | | 5/1996 | Fry | |
| 5,729,417 A | * | 3/1998 | Neiger et al. | 361/45 |
| 5,865,635 A | * | 2/1999 | Hsiang et al. | 439/188 |
| 6,111,210 A | | 8/2000 | Allison | |
| 6,229,107 B1 | * | 5/2001 | Flint et al. | 200/51.09 |

* cited by examiner

*Primary Examiner*—Elvin Enad
*Assistant Examiner*—Kyung S. Lee
(74) *Attorney, Agent, or Firm*—LaValle D. Ptak

(57) ABSTRACT

A shock-resistant electrical outlet is designed to prevent the application of power to the outlet only when a standard electrical plug is inserted nearly all of the way into the outlet. This is accomplished by providing at least two normally open switches in series circuit between the voltage line contact and an internal voltage contact which is engaged by the voltage prong of an electrical plug inserted into the outlet. The switches are closed by switch actuators located for simultaneous engagement by both the neutral and voltage prongs of an electrical plug when it is nearly fully inserted into the outlet to complete a circuit between the line voltage contact and the internal voltage contact in the voltage slot of the outlet.

18 Claims, 3 Drawing Sheets

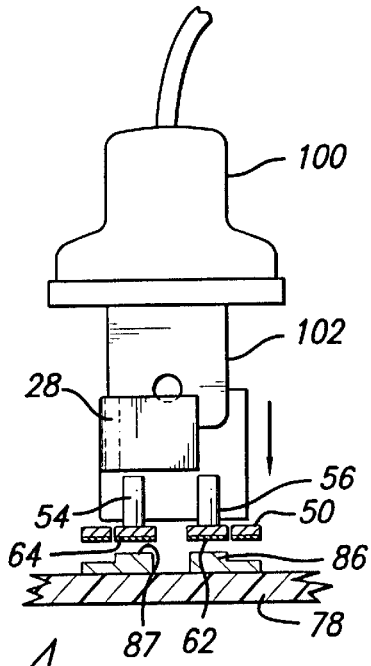
FIG. 4
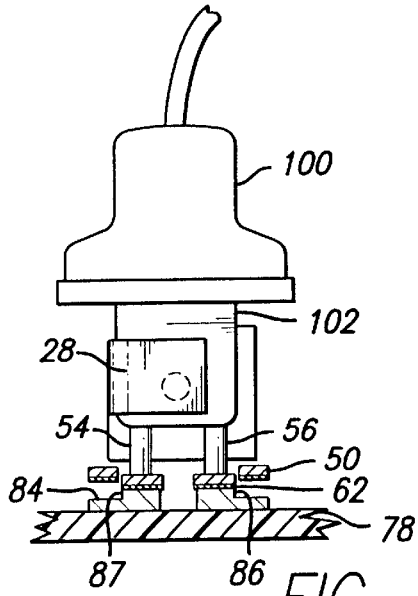
FIG. 4a
FIG. 5
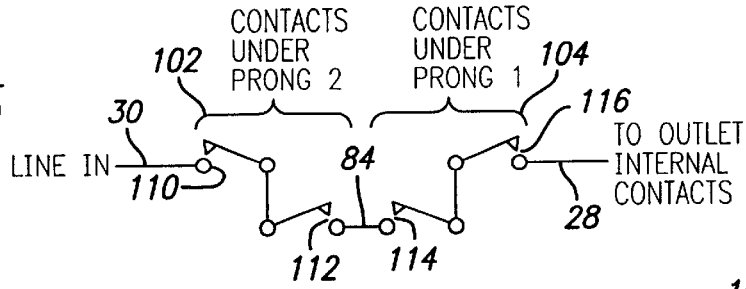
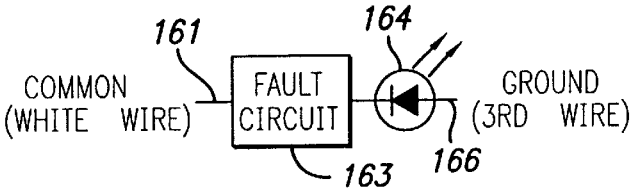
FIG. 6a
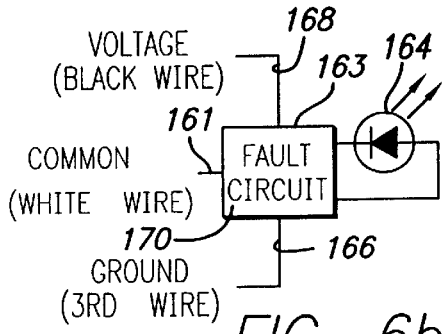
FIG. 6b
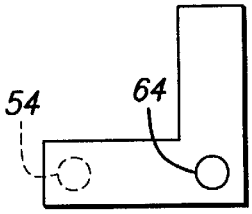
FIG. 7a
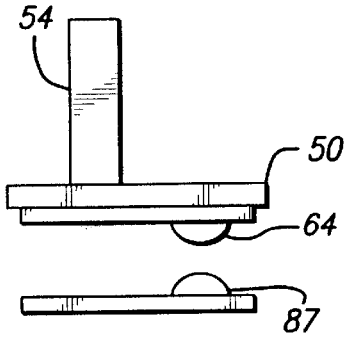
FIG. 7b
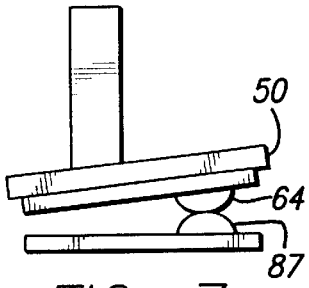
FIG. 7c

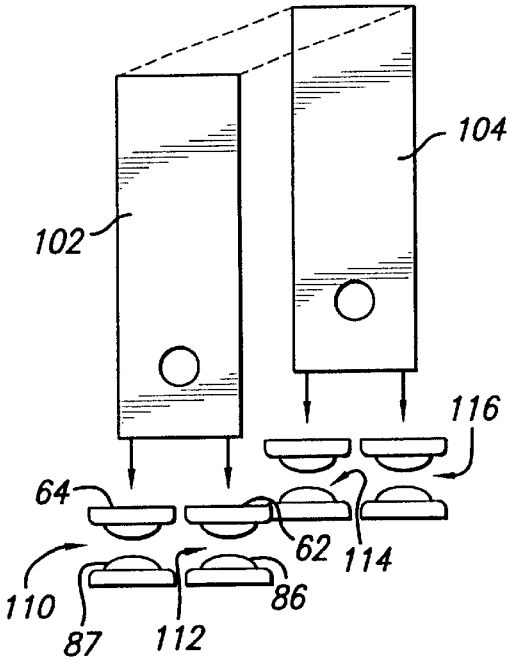
FIG. 8
FIG. 9
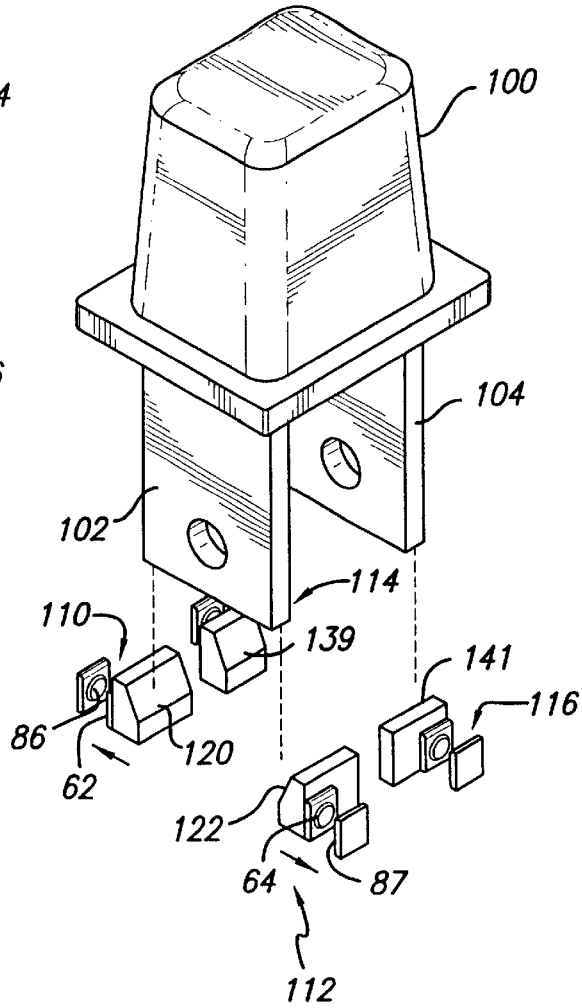
FIG. 10
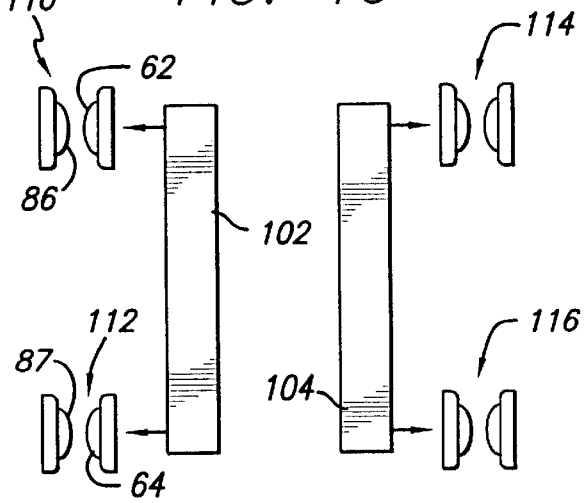
FIG. 11
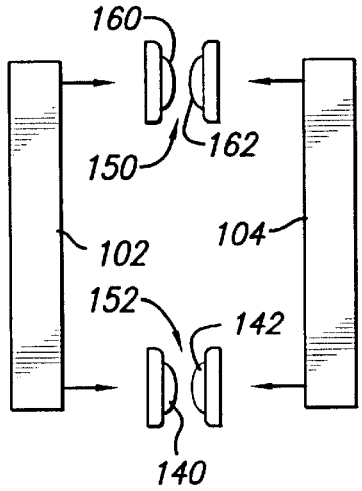

SHOCK-RESISTANT ELECTRICAL OUTLET

INVENTION DISCLOSURE DOCUMENT

This application is based on invention disclosure document 474323, filed on May 17, 2000.

BACKGROUND

In the United States, electrical outlets have become standardized to older, two-prong and newer, three-prong configurations. Currently, the three-prong configurations include a narrow opening or slot for the voltage prong of an electrical plug; and the neutral slot is somewhat wider. The third opening is for a ground connection; and, for three-prong plugs, this ground connection ensures the proper orientation of the plug in the outlet.

Typically, the exposed face of standard outlets has narrow openings which prevent even small children's fingers from coming into contact with any dangerous electrical current located within the receptacle. Children,-however, sometimes insert small metal objects, such as bobby pins, paper clips and screwdrivers, into the narrow openings of electrical outlets, with occasionally disastrous results.

Standard electrical outlets of the type described above also have an inherent hazard in conjunction with partially inserted plugs. The prongs of the plugs typically make electrical contact with the voltage and neutral lines through internal contacts in the plug before the plug is fully inserted. The small fingers of children, and even the fingers of adults, can bridge across the prongs of a partially inserted plug, resulting in an electrical shock and/or burn. If the child or adult has another part of his body in contact with an electrical ground, a serious injury or even fatality can result from such a shorting across the prongs of a partially inserted plug.

Attempts have been made in the past to provide safety features in electrical outlets to prevent electrical shock and injury. For example, the device of U.S. Pat. No. 2,540,496 to Sperrazza, is directed to an electrical outlet having a non-conducting cam block located approximately half-way down the length of each plug prong slot. This cam block forces together the contact points for the opposite side of the receptacle when plug prongs are inserted approximately half-way into the electrical outlet. Consequently, the outlet is made electrically hot while at least one half of the prongs of the plug being inserted are still exposed to contact by the person inserting the plug. This is required to prevent electrical arcing in the electrical outlet.

U.S. Pat. No. 2,751,527 to Bissell discloses an explosion-proof electrical connector system requiring a specialized electrical outlet and specialized mating electrical plug. There is no teaching of how to utilize this invention with a conventional residential or commercial electrical outlet commonly used for lamps, small appliances, office equipment and small power tools.

A different approach to providing safety measures in a common electric duplex outlet is disclosed in the U.S. Pat. No. 3,669,285 to Leatherman. This patent shows a device using a specialized form of the ground prong on a three-prong plug to make the electrical outlet hot. The device of this patent will not work with common polarized two-prong plugs, and only works with a three-prong plug having special configurations.

Yet another approach to using the ground prong of a three-prong plug to activate an electrical outlet is disclosed in the U.S. Pat. No. 3,755,635 to McGill. This patent discloses use of the ground prong to activate a low current microswitch, which in turn activates a relay allowing electrical current to flow to the plug. While not disclosed, the relay apparently is large enough to cause a standard duplex outlet to be able to contain only one plug outlet. There is no teaching of how to use a polarized two-prong plug (without ground) with this invention. In fact, such a plug, common on most small appliances, will not work with the device disclosed in this patent.

A safety duplex outlet for polarized two-prong and three-prong plugs is disclosed in the U.S. Pat. No. 5,095,182 to Thompson. The device described in this patent teaches the use of a microswitch mounted behind the large (neutral) slot of a standard polarized wall outlet. A person inserting a wire, paper clip or the like of any width which fits into the neutral slot of the outlet, could activate the microswitch at the bottom of the slot, and thereby circumvent the safety feature of the device of this patent. The addition of the microswitch mounted on the bottom of the outlet also prevents mounting of the outlet in a standard electrical box.

U.S. Pat. No. 5,347,095 to Zeder discloses an electrical outlet which emits an audible warning when an electrical plug is removed from it. There is no teaching of how to provide an electrically safe outlet, however.

U.S. Pat. No. 5,513,999 to Fry discloses activation of an outlet/plug assembly upon partial insertion of the plug into the outlet. The outlet and the plug, however, are of non-standard designs, which requires the replacement of both the common standard duplex outlet and the commonly provided polarized two-prong and three-prong plugs in order to use this outlet/plug assembly.

An improvement over all of the foregoing patents is disclosed in the device of U.S. Pat. No. 6,111,210 to Allison. This patent discloses an electrical safety outlet which activates only the outlet into which a plug is inserted in a multi-outlet receptacle; so that the unused outlets are not made electrically hot. The device of the Allison patent employs internal voltage contacts in the voltage slot for engagement by the voltage prong of a plug. The voltage line contact is not connected directly to the internal voltage contact, but instead is connected to one side of a switch, the other side of which is connected to the internal voltage contact. A cam is located in the neutral slot of the receptacle for engagement by the neutral prong of a plug inserted into the receptacle. When the prong reaches near the bottom of the neutral slot, the cooperation of a pair of cams functions to close the switch to apply voltage to the internal voltage contact. A single switch is used to interconnect the line voltage with the internal voltage contact to activate the plug. The placement of the cams is selected so that operation of the switch is extremely difficult unless the blade or prong of a standard electrical plug is inserted into the neutral side of the outlet.

The Allison patent discloses various cams and operating levers for effecting the closure of the voltage switch; and operation of both of the cams, or of the other mechanisms, with a paper clip, hairpin or the like, is nearly impossible. Even so, since the closure of electrical current to the voltage side of the receptacle is effected through operation of the neutral side only, it is remotely possible for the plug to be activated with an open voltage slot exposed.

It is desirable to provide an improved shock-resistant electrical outlet which is simple to construct and operate, and which provides an increased level of safety through the use of multiple series-connected switches between the line voltage contact and an internal voltage contact.

SUMMARY OF THE INVENTION

It is an object of this invention to provide an improved shock-resistant electrical outlet.

It is another object of this invention to provide an improved shock-resistant electrical outlet providing enhanced safety features with standard electrical plugs.

It is an additional object of this invention to provide an improved shock-resistant electrical outlet utilizing multiple series connected switches actuated by the prongs of an electrical plug and connected in series between a voltage line contact and an internal voltage contact in the outlet.

It is a further object of this invention to provide an improved electrical outlet in which no connection is made between a voltage line contact and an internal voltage contact engaged by the voltage prong of a plug until both the neutral prong of a plug and the voltage prong of a plug are nearly fully inserted into the outlet, to each engage actuators, all of which must be moved to interconnect series-connected switches between the voltage line contact and the internal voltage contact to energize the outlet.

In accordance with a preferred embodiment of the invention, a shock-resistant electrical outlet is constructed in the form of a plug receptacle having at least two slots, one of which is a voltage slot for receiving the prongs of an electrical plug. An internal voltage contact is provided in the voltage slot for engagement by the voltage prong of a plug; and an internal contact is provided in the other slot for engagement by the other prong of a plug. A line contact is conductively connected to the internal contact in the other slot. A voltage line contact is connected in series with at least two normally open switches connected in series electrical circuit between the voltage line contact and the internal voltage contact. Switch actuators are located for simultaneous engagement by both prongs of a plug inserted into the receptacle to close the normally open switches to complete the electrical circuit between the voltage line contact and the internal voltage contact of the receptacle.

BRIEF DESCRIPTION OF THE DRAWINGS

FIGS. 4 and 4A illustrate diagrammatically a feature of the operation of the embodiment of the invention shown in FIG. 1;

FIG. 5 illustrates an electrical interconnection of the embodiment shown in FIG. 1;

FIGS. 6A and 6B illustrate additional features useful in the embodiment of FIG. 1;

FIGS. 7A, 7B and 7C illustrate operating features of the embodiment of FIG. 1;

FIG. 8 is a further diagrammatic representation of the operation of the embodiment shown in FIG. 1;

FIG. 9 is a diagrammatic representation of an alternative to the embodiment shown in FIGS. 1, 4 and 8;

FIG. 10 is another alternative to the embodiments shown in FIGS. 1, 4, 8 and 9; and FIG. 11 is yet another alternative to the embodiments shown in FIGS. 1, 4, 8, 9 and 10.

DETAILED DESCRIPTION

Reference now should be made to the drawings, in which the same reference numbers are used throughout the different figures to designate the same or similar components. Several different embodiments, all employing the same inventive principle, are disclosed. All of these embodiment share a number of common characteristics. In the various embodiments of the invention disclosed, a metal object such as a bobby pin or paper clip cannot activate the switching mechanism to cause the receptacle to become "hot".

No voltage is present on the voltage side of the contacts until a plug having dimensionally-correct voltage and neutral prongs is inserted nearly fully into the outlet. The two halves of a duplex outlet each have separate switching mechanisms; so that inserting the prongs of a plug into one half of the outlet does not turn on or activate the other half of the outlet. Thus, the shock-resistant integrity of each half of the outlet is independent of the other. The switching mechanism which is subsequently disclosed in the various embodiments of the invention isolates the voltage side of the outlet (adaptable to both sides for 220 volt receptacles).

The ensuing description, reference is made at various times to the two prongs of an electrical plug. These two prongs may be the identical prongs utilized with older types of electrical plugs or of a three-prong grounded plug. The two prongs also may be dimensionally different prongs, in which the neutral prong is wider or has a wider end on it than the voltage prong; so that the plug always must be inserted in a proper polarity into the outlet. Finally, the two prongs which are described in the various embodiments may be the two prongs of a three-prong plug, in which the third prong is a ground prong in a standard triangular configuration with the other two prongs of the outlet.

Figure 1:
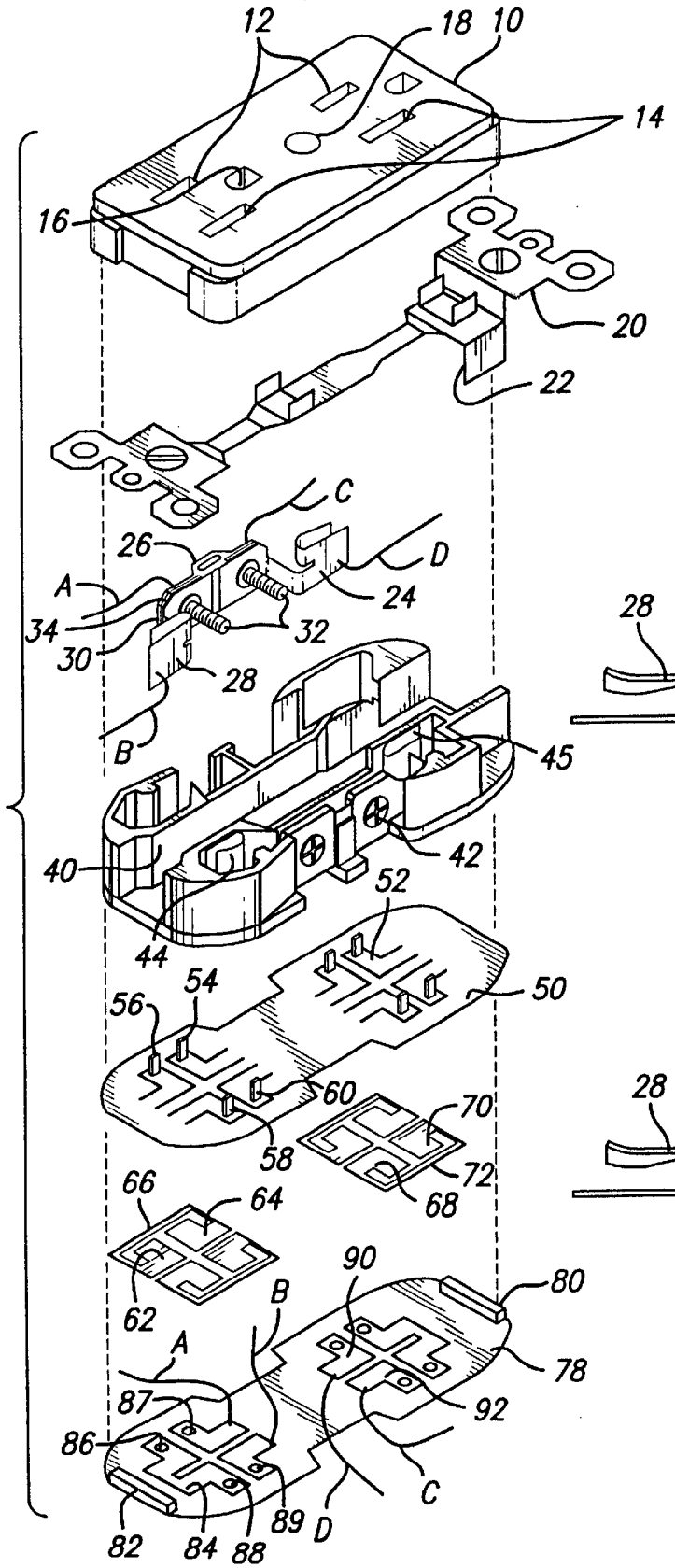
FIG. 1 is an exploded view of a preferred embodiment of the invention.

A preferred embodiment of the invention is shown in the exploded view of FIG. 1. It should be noted that the embodiment of FIG. 1, and of all of the figures, is designed to be compatible with a standard duplex wall electric outlet top molding, which is only diagrammatically indicated as 10 in FIG. 1. The receptacle is designed as a duplex wall receptacle in which the voltage slots 12 are located on one side, and wider neutral slots 14 are located on the other side. When the outlet is placed so that half-rounded ground prong slots 16 are located on the bottom, the neutral slots 14 are located on the left and the voltage slots 12 are located on the right. This is the common orientation for such outlets when they are installed in an electrical box. Basically, the slots 12 are approximately ¼" wide and the slots 14 are approximately 5/16" wide; so that the neutral prong of an electric plug cannot be inserted into the voltage slots 12.

The electrical outlet also includes a standard mounting bracket 20 having a ground wire connection 22 and a main body molding 40, which is generally configured in a manner similar to a standard duplex electrical outlet. Another common form of duplex electrical wall outlet has the mounting bracket/ground connection 20 mounted on the bottom (outside face) of the bottom molding corresponding to the main body molding 40, instead of between the top molding 10 and the main body molding 40. It should be understood that the invention disclosed in conjunction with the preferred embodiment of FIG. 1 also pertains to electrical wall outlets having more or less than two plug receptacles, as well as those having both switches and plug receptacles in them. In addition, it should be understood that the present invention may be utilized in ground fault interrupt (GFI) electrical outlets, power strips, surge protectors, uninterruptable power supplies, and other devices having standard outlets. The invention also readily may be adapted to 220 volt outlets of the type used for electric ranges, dryers and other configurations.

Completing the preferred embodiment of the invention shown in FIG. 1 is a voltage line contact member 30 coupled, but separated by an insulator 34 to an internal voltage contact 28 for one-half of the receptacle and a separate internal voltage contact 24 for the other half. This structure is shown in greater detail in FIG. 2, which illustrates the left side of the line contact member 30, along with the internal voltage contact 28, in greater detail. Essentially, the voltage contact comprises three parts separated by the insulators 34. The line contact part 30 has screw terminals for screws 32, as illustrated in FIGS. 1 and 3. In place of screw terminals, quick connect tabs, for grabbing wires inserted through holes in the bottom molding (not shown), also may be employed. The manner in which this is done is standard, and for that reason, this alternative has been shown only in FIG. 2.

Figure 2:
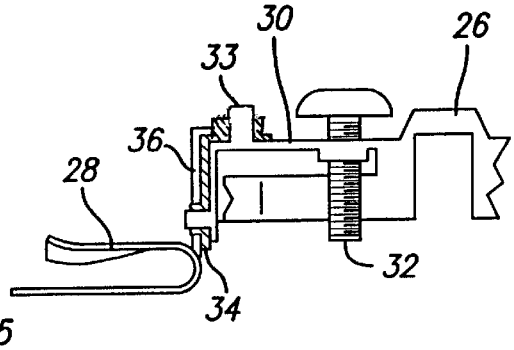
FIG. 2 illustrates a detail of a portion of the embodiment of FIG. 1.
Figure 3:
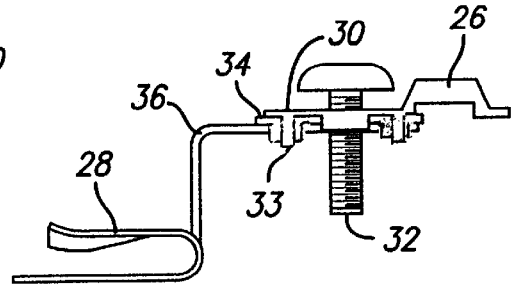
FIG. 3 illustrates another detail of a portion of the embodiment shown in FIG. 1.

The second and third parts of the voltage contact comprise the two internal voltage contacts 24 and 28 (one of which, 28, is shown in FIG. 2), which accommodate the voltage prong of an electrical plug. The two contacts 24 and 28 are separate from one another; and each are separated by an insulator (shown as 34 for the internal voltage contact 28 in FIG. 2) from the line contact 30. A similar insulator is employed to separate the internal voltage contact 24 from the voltage line contact 30.

The voltage line contact 26/30 is connected on one side through an electrical conductor A, which is an internal wire or an extension of contact parts, and on the other side by an electrical conductor C to two different switch sets, as described subsequently. Similarly, the internal voltage contacts 24 and 28 are connected, respectively, by internal electrical conductors D and B to the other side of the two different switch sets described subsequently. For a 220 volt application, both voltage contacts are constructed in the same manner as described for the line voltage contact illustrated in detail in FIG. 2.

The voltage contact assembly 24, 28, 30, fits into a mating cavity on the left side of the main body molding 40 illustrated in FIG. 1. On the right side of the main body molding 40 (as shown in FIG. 1), a corresponding cavity holds the neutral contact assembly. The neutral contact assembly in the embodiment illustrated in the various figures of this invention is conventional, and includes an external neutral line contact member 42, which is directly electrically interconnected with internal neutral contacts 44 and 45, shown in place in the cavity in the main body molding 40.

FIG. 3 shows a variation of the voltage contact set. The voltage contact set of FIG. 3 includes the portion 30 for screw terminals 32. These parts are electrically isolated by the insulator 34 and are physically connected by tabs 33. An extension 36 supports the internal contact assembly 28. This construction is shown located in place in the exploded view of FIG. 1.

The internal neutral contact 44/45 and neutral line member 42 are of standard configuration and are shown installed in the main body molding 40 in FIG. 1. The main body molding 40 of the outlet assembly of FIG. 1 has rectangular openings in the bottoms of the slots immediately below the internal voltage contacts 24 and 28 and the internal neutral contacts 44 and 45. A flexible non-conducting plate 50 is secured to the bottom of the main body molding 40; and four pairs of non-conducting pin actuators (two pairs of which are 54/56 and 58/60) extend upwardly from the plate 50 into the spaces at the bottom of the main body portion 40, directly beneath the two sets of slots 12/14 for each of the two sides of the duplex outlet.

The plate 50 is made of spring-like material, which is cut out as indicated in eight generally L-shaped tabs or fingers, each one of which supports a different one of the non-conducting pin actuators substantially at the end of each of the "L" tabs which are formed. These L-shaped tab cutouts form resilient springs which normally bias the pin actuators upwardly into the space at the bottom of each of the slots 12 and 14. For example, pin actuators 54 and 56 extend upwardly into the space at the bottom of the leftmost voltage slot 12 of the assembly shown in FIG. 1; and the pin actuators 58 and 60 extend upwardly into the bottom of the corresponding neutral slot 14 for the leftmost set of slots for receiving a plug in the left-hand portion of the receptacle.

Plated onto the underside of the plate 50, which is secured at least by its edges or the center portion to the bottom of the main housing assembly 40, are two sets of electrical contact patterns shown immediately beneath the plate 50. These patterns underlie the L-shaped spring tabs or fingers and are electrically connected in pairs, as is readily apparent from an examination of the patterns shown in FIG. 1. For example, patterns 62 and 64 are interconnected by a web 66 to form a common electrical circuit. The portions 62 and 64 directly underlie the spring tabs which support the non-conductive pin actuators 56 and 54, respectively, beneath the voltage slot 12 of the left-hand receptacle. Similarly, the patterns 68 and 70 are interconnected by a web 72 to directly underlie the two pin actuators beneath the neutral slot 14 on the right-hand receptacle. Similar connections are made for the other neutral slots and the voltage slots of each receptacle. All of the parts have not been numbered in FIG. 1 in order to avoid unnecessary cluttering of the drawing; but the patterns are clearly shown.

Beneath each of the electrical pattern sets for each side of the duplex plug receptacle, raised contacts are provided for making contact with fixed contacts located on electrical patterns on the face of a base plate 78 made of insulating material. The base plate 78 closes off the receptacle, and it is spaced by means of spacers 80 and 82 at each end (or entirely about the periphery thereof)a short distance from the bottom of the plate 50. This normally places a short space between the contacts on the electrical contact patterns, such as the pattern 62, 64, 66, and corresponding contacts, such as the contacts 86, 87, 88 and 89, located on pattern sets on the base plate 78 of the receptacle assembly. It should be noted that the contacts 87 and 89 are connected, respectively, to the conductors A and B forming the connections between the voltage line contact 30 and the internal voltage contacts, respectively, described above. The contacts 86 and 88 are connected in common by a conductive bridge 84. A similar set is provided for the other receptacle showing the connections of the conductors C and D to the contacts 92 and 90, respectively.

FIGS. 4 and 4A are a diagrammatic illustration of the functional operation of the cooperation between the non-conductive pin actuators and the spring-loaded switch contacts moved by the springs to effect closure of the various switches, the components of which are shown in FIG. 1. FIG. 4 shows a conventional electric plug 100 having a pair of prongs corresponding to the voltage and neutral prongs on it. Only the voltage prong 102 is shown in FIGS. 4 and 4A; but it is to be understood that the neutral prong functions in a similar manner to operate corresponding pin actuators 58 and 60 in the manner described previously. When the plug is inserted into the receptacle, the voltage prong 102 engages the internal voltage contact 28 in a conventional manner. To ensure electrical contact between the prong 102 and the voltage contact 28, various configurations of the internal contact 28 may be made to ensure a tight spring-like fit.

The pin actuators 54 and 56 extend upwardly from near the bottom of the receptacle, either beneath the internal voltage contact 28 or in the space between opposite sides of the contact 28, again as illustrated in FIG. 4. In this configuration, the plate 50 is spaced from the base plate 78, as illustrated; and the contact pairs 62/86 and 64/87 are spaced from one another.

As the prong 102 continues its downward travel into the receptacle, as shown in FIG. 4A, the two non-conductive pin actuators 54 and 56 are engaged by opposite corners of the prong 102 and are depressed downwardly. This occurs when the prong 102 is nearly fully inserted into the receptacle, approximately 1/16" from full insertion. The spring contacts 62 and 64, interconnected by the web 66, (and the similar other pairs or sets of spring contacts illustrated in FIG. 1) then are moved downwardly to cause the contacts 62 and 64 to engage, respectively, the mating contacts 86 and 87 to make electrical contact. The contact 86 is connected by the bridge 84 to the contact 88. At the same time, the voltage prong 102 effects the operation illustrated in FIGS. 4 and 4A, the neutral prong 104, forming the other half of the plug 100, effects the same operation enclosing switch sets 114 and 116, as shown in FIGS. 5 and 8. It should be noted that the pin actuators, such as 54, 56, 58 and 60, are located at the ends of the "L-shaped" spring cutouts in the plate 50. The contacts, such as 62 and 64, are located beneath the bight of the "L". This is done since mass produced plugs and outlets are by no means uniform and perfect. Since the outlet is energized when the plug is within approximately 1/16" of full insertion, there has to be some allowance for overtravel in the contacts. Most plugs would not press the four pins/actuators down out evenly, and there would almost surely be at least one contact that was not made. The offset placement is diagrammatically shown in FIGS. 7A to 7C.

FIG. 8 is a diagrammatic representation of the four pairs of switch contacts which are closed by the voltage prong 102 and the neutral prong 104 of a typical plug 100. FIG. 5 illustrates the electrical circuit interconnections which are effected by this operation. The line voltage at the line contact member 30 is connected by the conductor A to the contact 87 on the base 78. Similarly, the internal voltage contact 28 is connected by the conductor B to the contact 89 located beneath one corner of the neutral slot 14.

The electrical interconnections, which can be traced from the electrical circuit printed on the bottom of the plate 50 and on the top of the base 78, comprise four series-connected, normally open switches 110, 112, 114 and 116. The switch 110 comprises the contact sets 64 and 87. The switch 112 comprises the contact sets 62 and 86. The switch 114 comprises a contact set including the lower contact 88 and the switch 116 comprises the contact set comprising a lower contact 89 on the base 78, which in turn is connected to the internal voltage terminal 28 through the wire B. As is readily apparent, both prongs 102 and 104 must be nearly fully inserted into the receptacle in order to close all four of these switches to effect a conductive electrical circuit or energization between the line voltage on the voltage line contact member 30 and supplied through the screw 32 and the internal voltage contact 28. If any one of these switches 110, 112, 114 or 116 is open, the internal voltage terminal 28 is not provided with power; and the outlet is not energized or "hot". It is extremely difficult for a child, or anyone else for that matter, to obtain power on the internal voltage terminal 28 by poking safety pins, screw drivers, hair pins or the like into the slots 12 and/or 14 of the receptacle.

FIG. 9 is directed to an alternative embodiment of the invention in which the switches 110, 112, 114 and 116 are activated by actuators 120 and 122 for the voltage prong, and 139 and 141 for the neutral prong 104 of a plug 100 of the same type described above in conjunction with the embodiment shown in FIGS. 1 through 4 and 7. In the embodiment of FIG. 8, the actuators 120, 122, 139 and 141 are spring-biased inwardly toward the edges of the prongs 102 and 104 by means of any suitable bias member (not shown). The manner of operation of the circuit is identical to the one described above, inasmuch as it is necessary to move all four of the actuators 120, 122, 139 and 141 outwardly from the edges of the prongs 102 and 104 to effect closure of the four switches 110, 112, 114 and 116.

FIG. 10 is a variation of the embodiment shown in FIG. 9; but instead of engaging the actuators 120, 122, 139 and 141 with the edges of the prongs 102 and 104, the outside sides of the prongs 102 and 104 are used to move the movable contacts, such as 62 and 64 of the switches 110 and 112, and similar movable contacts of the switches 115 and 116 toward the left and right, respectively, as shown in FIG. 9, to effect closure with the fixed contacts located on the base plate 78. The system operates in the same way, requiring all four series-connected switches 110, 112, 114 and 116 to be closed in order to effect a connection between the line voltage at 30 to the internal voltage contact 28.

FIG. 11 illustrates yet another arrangement of contact pairs which can be utilized in place of those described previously. In FIG. 11, only two switches 150 and 152 are connected in series between the input line 30 and the internal voltage contact 28 of the receptacle. In place of four fixed contacts and four movable contacts for four switches, however, the embodiment of FIG. 11 employs two movable contacts for each of the switches 150 and 152, with the movable contacts for each switch being moved slightly more than half-way across the distance between them by the respective prongs 102 and 104 of the plug. Thus, full insertion of a prong, such as 102, into one of the slots of the receptacle does not close either one of the switches, since the contacts 140 and 160 which are moved by this prong do not move a sufficient distance by themselves to close the switches 150 or 152. Similarly, insertion of the prong 104 into its slot moves the contacts 142 and 162 half-way or part way across the distance between the contact pairs of the switches 150 and 152; so that closure of the switches is not effected by insertion of either a prong 104 or movement of one or the other of the contacts 142 and 162 toward the left, as viewed in FIG. 11. In order to complete a circuit from the line 30 to the internal voltage contact 28, both prongs 102 and 104 of the plug must be inserted nearly fully into the receptacle; so that both sets of switch pairs 140, 142 and 160, 162 are moved toward one another to make contact to close the two series-connected switches, which are interconnected in the same manner between the line 30 and the internal contact 28 as the four switches shown in FIG. 5.

FIG. 6A illustrates a fault circuit which is wired to light or flash an indicator light (such as an LED) if the outlet receptacle is not wired correctly (cross-wired). The primary concern is not having the voltage (black) external wire on the switched terminal, that is, having it wrongly connected to the neutral side 42/44/45 of FIG. 1. The fault circuit can be built into the receptacle, with the LED 164 visible from its surface. Fault circuits of this type are well known. The internal wiring connection is from the common terminal side of the receptacle on a conductor 161 to the fault circuit 163, connected in series with the warning lamp 164 (which may be an LED) to the ground terminal 166, which is connected to the terminal 22 of FIG. 1. If the voltage or power (black) wire and the neutral (white) wire are reversed and the ground wire is connected, the light 164 will be either on steady or flashing, depending upon the design of the fault circuit 163.

FIG. 6B shows a variation of the fault circuit which, in addition to detecting cross-wired faults as described above in conjunction with FIG. 6A, indicates a missing ground connection. The fault circuit of FIG. 6B is similar to that of FIG. 6A except that both the common or white wire 161 and the voltage or black wire 168 are wired into a standard fault circuit 170 of the type designed to indicate either cross-wired conditions or missing ground connections, or both, through a warning light (LED) 164. Fault circuits of the type used in the fault circuit 170 are employed in electrical testing equipment, and readily can be built into the receptacle, if desired. An indication can be employed to indicate directly the nature of the problem, for example, using a flashing light for a cross-wired condition as described above in conjunction with FIG. 6A, and a steady light condition of the light 164 for a missing ground connection. Or, the different indicia may be indicated by using different colors of light.

The foregoing description of the preferred embodiment of the invention is to be considered as illustrative and not as limiting. As is readily apparent from an examination of the different alternatives described in conjunction with FIGS. 1 through 7, 8, 9, and 10, the specific implementation of the inventive concept can be effected in a number of different ways. Various other changes and modifications will occur to those skilled in the art for performing substantially the same function, in substantially the same way, to achieve substantially the same result, without departing from the true scope of the invention as defined in the appended claims.

What is claimed is:

1. A shock-resistant electrical outlet including in combination:

a plug receptacle having at least two slots, one of which is a voltage slot for receiving a voltage prong and another slot for receiving at least one other prong of an electrical plug;

an internal voltage contact in the voltage slot for engagement by the voltage prong of a plug;

an internal contact in the other of the slots for engagement by the one other prong of an electrical plug;

a line contact conductively connected to the internal contact in the other of the slots;

a voltage line contact;

at least two normally open switches connected in series electrical circuit between the voltage line contact and the internal voltage contact;

a first switch actuator located for engagement by the voltage prong of an electrical plug inserted into the voltage slot of the plug receptacle to close one of the two normally open switches; and a second switch actuator located for engagement by the at least one other prong of an electrical plug inserted into the other of the slots of the plug receptacle to close the other of the two normally open switches to complete an electrical circuit through the two switches between the voltage line contact and the internal voltage contact when both prongs are simultaneously inserted.

2. The electrical outlet according to claim 1 wherein the location of the switch actuators is such that the switches are not closed until both prongs of an electrical plug are nearly fully inserted into the plug receptacle.

3. An electrical outlet according to claim 2 wherein the at least two normally open switches comprise four normally open switches connected in series electrical circuit and each having a fixed contact and a movable contact wherein two of the movable contacts are engaged by the other prong of an electrical plug to effect closure of two of the switches, and two of the movable contacts are engaged by the voltage prong of an electrical plug to close the other two of the switches.

4. The electrical outlet according to claim 2 wherein the other of the slots is a neutral slot, and the neutral slot and the voltage slot of the plug receptacle each have an open prong receiving end with a bottom spaced a predetermined distance from the open plug receiving end, and wherein the switch actuators are located in the bottoms of the prong receiving slots.

5. The electrical outlet according to claim 4 further including four normally open switches connected in series circuit between the voltage line contact and the internal voltage contact, with two of the switches located for closure by switch actuators associated with the neutral slot and two of the switches located for closure by switch actuators associated with the voltage slot.

6. The electrical outlet according to claim 5 wherein the switch actuators associated with both the neutral slot and the voltage slot are located adjacent the bottoms of the slots for engagement by nearly fully inserted neutral prong and voltage prong of an electrical plug.

7. The electrical outlet according to claim 6 wherein the switch actuators are engaged by the bottom ends of the neutral prong and voltage prong of an electrical plug.

8. An electrical outlet according to claim 6 wherein the switch actuators are designed to be engaged by the sides of the neutral and voltage prongs of an electrical plug.

9. An electrical outlet according to claim 2 wherein the two at least normally open switches each comprise first and second movable contacts, one of which is engaged by a neutral prong of an electrical plug and the other of which is engaged by the voltage prong of an electrical plug to close the switch.

10. An electrical outlet according to claim 1 wherein the at least two normally open switches comprise four normally open switches connected in series electrical circuit and each having a fixed contact and a movable contact wherein two of the movable contacts are engaged by the other prong of an electrical plug to effect closure of two of the switches, and two of the movable contacts are engaged by the voltage prong of an electrical plug to close the other two of the switches.

11. The electrical outlet according to claim 1 wherein the switch actuators associated with both of the slots are located adjacent the bottoms of the slots for engagement by nearly fully inserted neutral prong and voltage prong, respectively, of an electrical plug.

12. The electrical outlet according to claim 11 wherein the switch actuators are engaged by the bottom ends of the neutral prong and voltage prong of an electrical plug.

13. An electrical outlet according to claim 11 wherein the switch actuators are designed to be engaged by the sides of the neutral and voltage prongs of an electrical plug.

14. An electrical outlet according to claim 11 wherein the two at least normally open switches each comprise first and second movable contacts, one of which is engaged by a neutral prong of an electrical plug and the other of which is engaged by the voltage prong of an electrical plug to close the switch.

15. The electrical outlet according to claim 1 wherein the other of the slots is a neutral slot, and the neutral slot and the voltage slot of the plug receptacle each have an open prong receiving end with a bottom spaced a predetermined distance from the open plug receiving end, and wherein the switch actuators are located in the bottoms of the prong receiving slots.

16. The electrical outlet according to claim 15 further including four normally open switches connected in series electrical circuit between the voltage line contact and the internal voltage contact, with two of the switches located for closure by switch actuators associated with the neutral slot and two of the switches located for closure by switch actuators associated with the voltage slot.

17. The electrical outlet according to claim 1 further including a fault circuit built into the plug receptacle for providing an indicia of incorrect wiring to the line controls of the receptacle.

18. The electrical outlet according to claim 17 wherein the indicia is an LED display.

* * * * *